United States Patent [19]

Sickles

[11] 4,009,829

[45] Mar. 1, 1977

[54] ELECTROSTATIC SPRAY COATING APPARATUS

[75] Inventor: James E. Sickles, Glenshaw, Pa.

[73] Assignee: PPG Industries, Inc., Pittsburgh, Pa.

[22] Filed: Feb. 11, 1975

[21] Appl. No.: 548,958

[52] U.S. Cl. ..... 239/15; 118/629; 427/27; 361/228

[51] Int. Cl.[2] ..... B05B 5/02

[58] Field of Search ..... 239/3, 15; 118/620, 118/621, 624, 627, 628, 629, 640; 317/2 R, 3, 262 R; 427/13, 25–27, 30, 45

[56] References Cited

UNITED STATES PATENTS

| | | | |
|---|---|---|---|
| 2,491,889 | 12/1949 | Bennett et al. | 317/3 |
| 2,976,175 | 3/1961 | Reindl | 239/3 X |
| 3,613,993 | 10/1971 | Gourdine et al. | 239/15 X |
| 3,698,635 | 10/1972 | Sickles | 239/3 |
| 3,700,168 | 10/1972 | Ferrant | 239/3 |
| 3,900,000 | 8/1975 | Gallen | 118/629 X |

*Primary Examiner*—Evon C. Blunk
*Assistant Examiner*—Andres Kashnikow
*Attorney, Agent, or Firm*—J. Timothy Keane; Carl T. Severini

[57] ABSTRACT

An improved electrostatic spray charging device for spray guns is disclosed. The device comprises an adapter formed from a dielectric material in the shape of a generally cylindrical tube adapted at one end to be secured to the end of a conventional spray gun and constructed at the second end to provide an inductive charging field for materials discharged by the spray gun. The second end of the adapter is formed, in the preferred embodiment, into two diametrically opposed lobes, each of which carries on its interior surface at least one charging plate to which a d.c. voltage on the order of 10–20 KV is applied. The exterior surface of each lobe carries an electrically grounded electrode which preferably is annular in shape to provide an electric field configuration that prevents accumulation of charged spray particles on the exterior surfaces of the adapter.

35 Claims, 9 Drawing Figures

FIG. 1
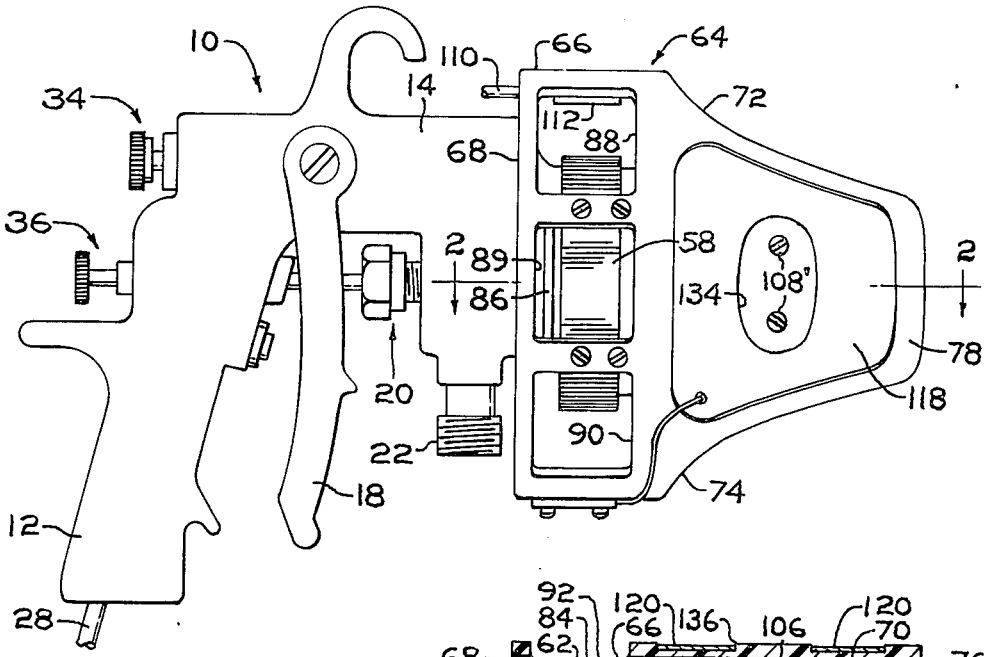
FIG. 2
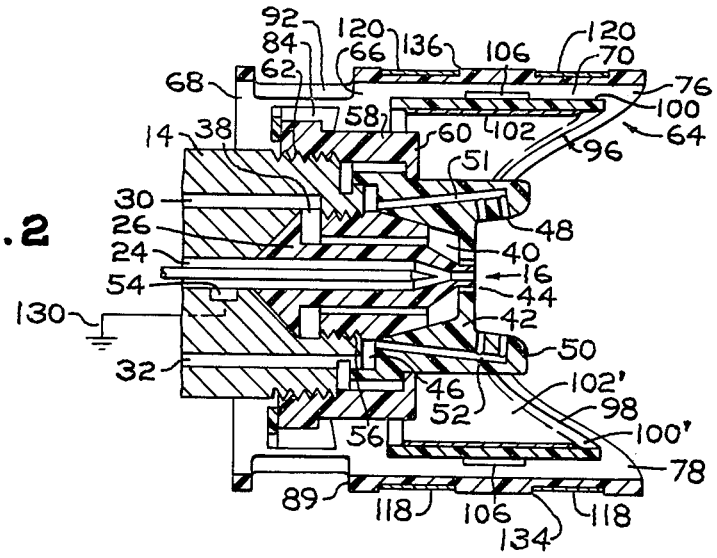
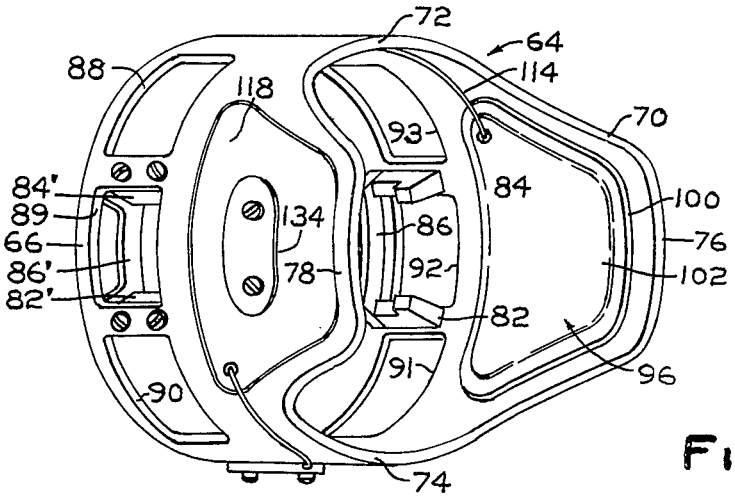
FIG. 3

ELECTROSTATIC SPRAY COATING APPARATUS

BACKGROUND OF THE INVENTION

The present invention relates, in general, to spray coating apparatus of the electrostatic type, and more particularly to an adapter for use in converting conventional liquid spray guns to electrostatic use wherein the spray particles are subjected to an electrostatic field which induces a charge on the particles.

Induction charging of liquid spray particles is a technique that is known in the art, and is discussed in copending application Ser. No. 456,944 of James E. Sickles, filed Apr. 1, 1974 and assigned to the assignee of the present application now abandoned. As stated in that application, the principle of providing an electrostatic field for charging atomized liquid particles and utilizing the charged particles for coating an article has been in general use for many years. A great variety of spray gun, configurations have been devised for such systems, some of which work reasonably well and some of which are less than satisfactory. Virtually all of these prior electrostatic devices have in common a spray gun to which is mounted a high voltage electrode disposed adjacent the spray discharge point and carrying an electrical potential in the neighborhood of from 50 to 85 kilovolts, and in certain instances as high as 150 kilovolts. The voltage on this electrode creates a corona discharge condition and the resulting electric field creates a region rich in ions through which the spray particles must pass. Some of these ions become attached to the spray droplets, producing electric charges on the particles which may then be directed toward a workpiece which is electrically grounded and which therefore attracts the particles.

Use of the corona discharge type of electrostatic spray coating apparatus presents numerous difficulties, principally as a result of the very high voltages that must be utilized to produce effective operation. First of all, the requisite charging voltages are conventionally obtained through the use of standard electronic high voltage power supplies which are relatively large, heavy, and expensive. Because of the high voltages involved, the cable interconnecting the power supply and the spray gun charging electrode must necessarily be heavily insulated and thus is bulky, relatively inflexible, and, again, very expensive. The size and weight of the power supply and its cable substantially restrict the usefulness of the conventional corona effect spray gun because of the difficulties encountered in handling and moving it, and the high cost limits its availability. Furthermore, the use of such high voltages is hazardous, not only because of the possibility of creating electrical arcs when the gun is moved too near a grounded object, but because of the possible danger to the operator should he inadvertently touch the high voltage electrode. Finally, the high voltages used in such systems create an excessive current flow in the form of ions which may travel to nearby objects, resulting in undesired charge buildup on any objects that are not adequately grounded. The hazard of sparking and consequent possible fire exists when the operator or some other grounded object is brought close to such a charged object. Further, the migration of such charges can cause an undesired buildup of the charged spray particles on objects other than the workpiece. Such a buildup can occur on the grounded spray gun itself and can result in clogging of the gun and premature shutdown for cleaning.

As set forth in the above-mentioned copending application, it has been found that effective electrostatic spray coating can be accomplished through the use of induction charging apparatus which eliminates the need for the very high voltages used in the corona discharge type of electrostatic charging. Induction charging of liquid particles in spray discharge devices is accomplished by surrounding the discharged spray with a static electric field which has an average potential gradient in the range of about 10 to 20 kilovolts per inch, with the liquid being held at ground potential. The spacing between the liquid and the source of potential is sufficient to prevent an electrical discharge so that a capacitive-effect is produced. The static field so provided induces on liquid particles produced within the field an electrical charge having a polarity which is opposite to that of the applied voltage, with the particles carrying quantities of the charge. The resulting charged particles may then be directed, for example, at an electrically grounded workpiece, striking it to provide a coating of the liquid on the workpiece. Such induction charging techniques have been found to be particularly useful in spray systems utilizing electrically conductive liquids such as water base paints, since the liquid can be electrically grounded. This is a considerable improvement over corona discharge and other high voltage spray devices which utilize a high voltage needle electrode in contact with the liquid. In such devices, the liquid is at the same high voltage as the electrode, requiring that the liquid be electrically isolated to prevent excessive current flow and to insure the safety of the operator. Such isolation not only requires bulky and expensive electrical insulation, but produces a system which is inconvenient to use. The lower voltages used and the grounded of the liquid supply in an induction type of system eliminates the problems inherent in high-voltage isolated systems, thus reducing the danger of operator injury, providing increased convenience and flexibility in use, reducing the danger of arcing if the spray gun is moved too close to a grounded object, and reducing the intensity of the arc, and the danger of fire, if arcing should occur.

To enable conventional non-electrostatic spray guns, as well as spray guns of the very high voltage, corona discharge type, to be converted to induction charging devices, the aforementioned copending application described an adapter which may be secured to a spray nozzle to surround the discharge ports of the spray gun and to produce a charging zone through which pass liquid particles exiting from the nozzle discharge ports. The adapter is located exteriorly of the conventional air and liquid discharge ports and is spaced radially outwardly therefrom. In the copending application, the inductive charging means was illustrated as including a cylindrical dielectric tube having a thin conductive film such as a metallic foil adhered to the interior surface thereof, the tube circumferentially surrounding the discharge ports to define a charging zone. Means were provided in that device for applying between the conductive film and the electrically grounded liquid a d.c. voltage of less than about 20 kilovolts to produce a preferred average potential gradient within the charging zone of between about 5 to about 20 kilovolts per inch.

Although the inductive charging device of application Ser. No. 456,944 operates satisfactorily, it has been found that the cylindrical shape in some operational modes interferes with the discharge pattern of the spray, with the result that in such situations the inductive charging device can become coated with the spray material, thereby reducing operating efficiency. Further, it has been found that the collection of charged particles on the outer surface of the inductive charging tube over a prolonged period of operation could produce surface leakage paths between the high voltage electrode and ground, thereby reducing the voltage available for operation and making it necessary to shut down the unit for cleaning. Finally, because the induction charging device of the above-mentioned copending application utilized a moderately high voltage, some slight danger of injury to the operator or of arcing remained, even though such dangers were substantially reduced from the problems produced by prior very high voltage systems.

SUMMARY OF THE INVENTION

It is, accordingly, an object of the present innvention to produce an improved induction charging system for use with conventional spray guns of both the electrostatic and nonelectrostatic types for providing induction charging of discharged spray particles.

Another object of the present invention is to provide an improved induction charging adapter capable of attachment to conventional spray gun nozzles whereby such conventional guns may be converted to induction charging systems.

Another object of the invention as to provide an improved adapter for converting spray guns to induction operation wherein the adapter is shaped to permit improved spray patterns while providing a suitable electrostatic field for inductively charging the spray particles.

It is a further object of the present invention to provide an improved adapter for converting spray guns to induction operation wherein the adapter is shaped to provide an improved electrical field configuration for the spray particles, and wherein accumulation of charged particles on the exterior surface of the adapter is virtually eliminated.

It is another object of the invention to provide an electrostatic induction charging device having charging electrodes arranged to provide not only an improved electrical field pattern within the adapter, but to provide an improved air flow through the adapter to minimize turbulence and to produce desired spray patterns.

Briefly, the present invention is directed to an improved electrostatic spray charging device formed from a dielectric material and adapted to be secured at one end to the spray nozzle of a conventional hand-held or automatic spray gun of either the electrostatic or nonelectrostatic type. Although other configurations may be used, the device in a preferred form generally will be tubular, and is arranged to be mounted in spaced relationship to the spray nozzle. The forward end of the device preferably extends beyond the end of the spray nozzle and is formed in the shape of two diametrically opposed, forwardly extending lobes, each of which carries on its interior surface a charging electrode. A high d.c. voltage is applied between these electrodes and the liquid being sprayed to establish an electrostatic field within the charging zone defined by the device. The voltage is less than that required to cause corona discharge, but produces a potential gradient in the region near the liquid being sprayed of sufficient value to insure that charges are induced on the particles sprayed from the nozzle.

The average potential gradient between the electrodes and the liquid supply may be defined as the average value of the voltage change per unit of radial distance between the axis of the liquid stream and the electrodes, and may be calculated by dividing the radial distance into the value of the applied voltage. It will be understood that the actual gradient will vary, having a lower value near the electrodes and having a much greater value at or near the location in the liquid stream where the spray particles are formed to produce the inductive charging effect, but for convenience in this disclosure, reference will be made to the average value.

The electrical potential existing at any given point within the charging zone will depend upon the configuration of the electric field, and this will be influenced by factors such as the size and shape of the electrodes, the shape of the surface of the liquid stream, and the amount and location of the charge carried by spray particles within the zone. Each charging electrode may be in the form of a curved dielectric mounting plate carrying on its inner surface an electrically conductive metallic film, foil, or the like, and each mounting plate is secured to a corresponding lobe in spaced relationship to the lobe to support the electrodes so as to define a charging zone in the path of spray particles discharged from the nozzle. The curved electrodes of a preferred form of the invention are concentric to the axis of the spray nozzle to produce an electrostatic field configuration within the charging zone that will result in the desired potential gradient near the liquid stream being sprayed from the nozzle. The charging device is cut away between the two lobes to provide diametrically opposed openings which accomodate fan-shaped spray patterns of the type commonly used in spray painting.

The exterior surfaces of the two lobes carry electrodes in the form of electrically conductive films, such as metallic foils or the like, which are connected to an electrical ground point. These grounded electrodes prevent the buildup of positive charges on the spray gun adapter, thereby insuring operator safety, reducing the danger of arcing, and substantially eliminating the collection of charged spray particles on the exterior surface of the adapter. In a preferred form, the exterior electrode is formed with a central opening wherein each electrode takes on a generally annular configuration, thereby modifying the electrical field around the charging device and providing an improved resistance to contamination by the charged particles being sprayed. Thus, the present device provides improved inductive charging of spray particles while at the same time reducing interference of the charging apparatus with the spray pattern and thereby producing a cleaner and safer electrostatic charging device.

Although the inductive charging device illustrated herein takes the form of a pair of curved electrodes mounted to the interior surface of a generally cylindrical, or tubular, housing, it will be understood that this specific structure is merely illustrative, and that other configurations may be provided. Thus, the support need not be cylindrical, but may take some other geometric form consistent with its functions of supporting the charging electrodes in spaced relationship to the discharge nozzle and facilitating the nonturbulent flow of air past the nozzle and the flow of air and entrained spray particles through the charging zone. The support serves a primarily mechanical function and is tubular in its preferred form for ease and economy of fabrication, handling, and mounting, and for its strength and consequent mechanical protection of the charging electrodes and the spray nozzle. The tubular form is also particularly well suited to the additional functions of supporting the charging electrodes adjacent the path of the sprayed particles in such a way as to produce an electrostatic field having the configuration and the average potential gradient within the charging zone adjacent the spray nozzle required to induce charges on the particles, and of preventing undue interference with the aspirating effect produced by the various air and atomized liquid streams emitting at the nozzle. This aspriating effect draws some ambient air around and along the spray gun which has the effect of reducing turbulence in the spray zone. Accordingly, in a preferred form of the invention, the charging electrode support takes the cylindrical form illustrated.

The illustrated arrangement of the charging electrodes provides the required electrostatic field for charging the spray particles, without interfering with the spray pattern or interrupting the flow of air around the nozzle. Configurations other than the pair of curved electrodes illustrated herein can be used, and the number of electrodes may vary as long as the required field configuration and average potential gradient is maintained between the electrode and the liquid. Two curved electrodes, one on each side of the spray nozzle, are convenient for this purpose, and are usually preferred. However, a larger number of electrodes could be provided, as long as care is taken to insure that there is no undue increase in the amount of current drawn by the device, that any tendency for arcing or corona discharge is avoided, and that charges having a polarity opposite to that generally produced by the induction charging system are not produced. Further, the number, shape and arrangement of the electrodes should be chosen to minimize the turbulent air flow around the spray nozzle which reduces the effectiveness of the device.

In the present invention, the foregoing features are embodied in an induction charging device in the form of an adapter which may be easily secured to the exterior of any conventional spray gun by means of suitable supports. These supports may frictionally engage the outer surface of the gun, may be shaped to snap onto the gun, or may be constructed to otherwise hold the adapter firmly in place during use. The adapter is provided with suitable terminals and lead wires for connecting the charging electrodes to a d.c. voltage source and the ground electrodes to a convenient reference or earth point. The charging device of the present invention, with its various configurations of the support housing and the induction electrodes and exterior grounded electrodes supported thereon will be referred to hereinafter as an adapter, although it will be apparent that the charging device may be constructed as an integral or permanent part of a spray gun or spray nozzle without departing from the invention.

BRIEF DESCRIPTION OF THE DRAWINGS

The foregoing and additional objects, features and advantages of the present invention will be apparent to those of skill in the art from a consideration of the following detailed description of a preferred embodiment of the invention, taken in conjunction with the accompanying drawings, in which:

FIG. 1 is a side elevation of a typical spray gun, shown in diagrammatic form, to which is connected an electrostatic induction charging adapter in accordance with the present invention;

FIG. 2 is a partial sectional view of the spray gun and adapter taken along line 2—2 of FIG. 1;

FIG. 3 is a perspective view of the adapter of FIG. 1, illustrating the arrangement of parts in the adapter;

DESCRIPTION OF PREFERRED EMBODIMENTS

Figure 4:
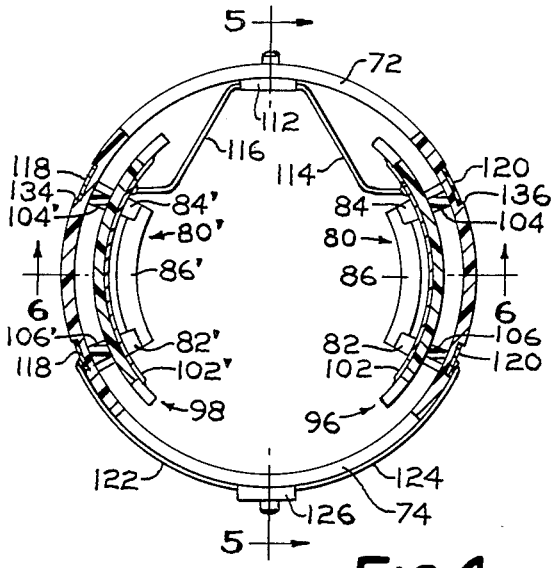
FIg. 4 is a front view of the adapter of FIG. 3.

Referring now to the drawings, and more particularly to FIGS. 1 and 2, there is illustrated at 10 a conventional air-operated spray gun having a handle portion 12, a barrel 14, and a nozzle assembly generally indicated in FIG. 2 at 16. The illustrated spray gun is a hand held device having a conventional trigger mechanism 18 which operates valve means generally indicated at 20 to admit liquid from a supply source (not shown) to the gun. The liquid is fed to the spray gun through a suitable connector 22 which may be threaded to receive a correponding connector on a liquid feed hose or the like (not shown) leading from the supply of liquid. The liquid to be sprayed passes through the valve means 20 and flows through a fluid passageway 24 (FIG. 2) controlled by a conventional needle valve to a liquid nozzle 26 for discharge as an atomized spray of droplets. A propellant or atomizing fluid such as air or another suitable gas is applied under pressure to the nozzle assembly by way of an air hose 28 and through suitable passageways in the body of the spray gun. In order to provide the required degree of atomization and to regulate the discharge pattern of the spray, the air supply is divided into two separate passageays 30 and 32 (FIG. 2), with the air flow in the passageways being controlled by manually adjustable control valve generally indicated at 34 in FIG. 1. A second control valve 36 permits adjustment of the needle valve in pasageway 24, in conventional manner.

In accordance with known spray nozzle construction, the air flow in one of the air passageways, for example passageway 30, is directed to an annular chamber 38 within the spray nozzle 26 from which the air flows forward to a second annular chamber 40 defined between the forward end of the nozzle 26 and the interior of an air cap 42. The air cap incorporates a plurality of apertures, such as annulus 44 surrounding the outlet port of nozzle 26, which serve to direct air from chamber 40 to shape the flow of liquid from the nozzle 26 in known manner.

The flow of air from passageway 32 is directed to an annular chamber 46, also defined by the air cap 42. The air cap disclosed in this embodiment incorporates a pair of diametrically opposed ears 48 and 50 which extend forwardly from the discharge point of nozzle 26 and which contain air passageways 51 and 52 connected to the annular chamber 46. These passageways serve to direct air toward the atomized liquid being discharged from nozzle 26 to shape the pattern of the discharge. By regulating the rates of flow of the various streams and streamsand of the liquid stream, a spray discharge having the desired characteristics may be produced.

In accordance with the present invention, the nozzle assembly 16, including the liquid nozzle 26 and the air cap 42, is generally conventional, but is constructed of a dielectric, or electrically nonconductive, material and the liquid being supplied is electrically grounded, as by means of a ground plate 54, in order to insure proper induction charging. The liquid nozzle 26 may be secured in the barrel 14 of the spray gun by any suitable means, as by threads 56. Similarly, the air cap 42 is secured to the barrel 14 by suitable means such as an annular nut 58 having an inner shoulder portion 60 which engages a corresponding shoulder on the air cap and which is threaded onto the exterior of barrel 14 as by means of threads 62.

The dielectric material from which the nozzle assembly is made is selected not only for its electrical insulative qualities, but for its mechanical properties of rigidity, machinability, and strength in the case of the air cap 42 and the nut 58, and for its ability to withstand the wearing effects of the liquid in the case of the nozzle 26. Although the entire nozzle assembly may be constructed of a single material, there may on occasion be good mechanical reasons for selecting different dielectric materials for these elements. The dielectric material selected for this assembly must be capable of withstanding the stresses associated with the highest voltages provided by the power supply without an accompanying breakdown or rupture of the material. Suitable materials include acetal resins, epoxy resins, glass filled epoxy resins, glass filled nylon, and the like. While it is highly desirable that the nozzle assembly be fabricated entirely from dielectric materials, it has been found that parts of the nozzle may be made of, or have adhered thereto, a conductive material as long as such conductive material is not electrically grounded. It has been found that when grounded metal parts are used for the nozzle assembly, the charging efficiency drops drastically, in some cases by as much as about 75%. While a specific type of nozzle has been shown in FIG. 2, it is to be understood that essentially any air-atomized spray nozzle would be usable with the instant invention, provided that all parts of the nozzle are either electrically nonconducting or are ungrounded; that is, that they are of dielectric nature. Other conventional spray nozzles are disclosed in numerous publications including, for example, U.S. Pat. Nos. 3,169,882; 3,587,967; 3,591,080; 3,613,401; 3,692,241; 3,746,253; 3,747,850; 3,764,068; and 3,764,069.

Figure 5:
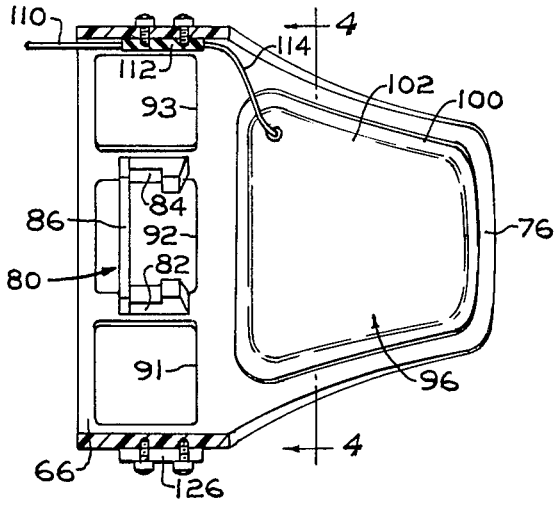
FIG. 5 is a cross-sectional view of the adapter of FIG. 4, taken along lines 5—5.

Mounted on the exterior of spray gun barrel 14, and concentric with the liquid discharge port, is an induction charging adapter 64 made in accordance with the present invention. Adapter 64 is illustrated in perspective view in FIG. 3, in side elevation in FIG. 1, in cross section as mounted on the spray gun in FIG. 2, in end view of FIG. 4, in cross section in FIGS. 5 and 6, and in a bottom view in FIG. 7. As illustrated, the adapter is essentially a cylindrical housing, or tube 66 formed of a dielectric material and having a reward portion 68 adapted to be secured to the spray gun and a forwardly extending portion 70 adapted to surround the path of the discharged spray material. Diametrically opposed portions of the forward part of the dielectric tube are cut away at 72 and 74 (See FIG. 3), leaving shaped, forwardly extending, opposed lobes 76 and 78 remaining. The lobes 76 and 78 carry charging electrodes, to be desired, for which a d.c. voltage is applied for inductively charging the spray particles, while the cutaway portions 72 and 74 prevent interference by the tube with generally fanshaped patterns which may be produced in the spray, and assist in the aspiration of ambient air through the tube. Again, it will be understood that the dielectric tube may be constructed of any suitable material capable of withstanding the high voltages used in the present device, and in particular may utilize one of the dielectric materials listed hereinabove.

Figure 9:
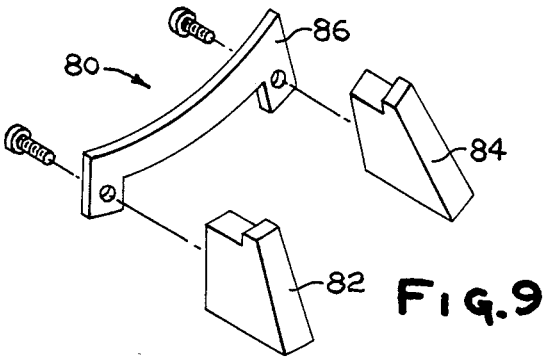
FIG. 9 is an exploded perspective view of a support suitable for use in securing an adapter to a spray gun.

The adapter 64 is attached to the end of spray gun 10 by means of suitable mounts which are shaped to engage the outer surface of the barrel or of the annular nut 58. Although the exact shape of the mounts will depend upon the construction of the particular barrel to which the adapter is to be connected, the mounts in general are formed to secure the adapter in concentric relationship with the discharge orifice. In the embodiment illustrated herein, two such supports 80 and 80' are secured, as by means of screws, to diametrically opposite locations on the interior wall of the rearward portion of tube 66. As may be seen in FIGS. 4, 5 and 9, support 80 consists of a pair of leg elements 82 and 84, and support 80° includes elements 82' and 84', which are adapted to be secured to the wall of the tubular housing. The upper surface of each leg portion is shaped to engage a corresponding shoulder portion formed on the exterior of nut 58, as illustrated in FIG. 2. Thus, the forward portion of each leg has an upstanding flange which is adapted to abut the exterior shoulder on the nut. In mounting the adapter on the spray gun, the adapter is pushed onto the front of the gun, is centered so that the leg elements 82 and 84, 82' and 84', will fit over the nut 58, and the adapter is then moved rearwardly on the gun until the flanges on the leg elements engage the exterior shoulder on the nut. A retainer plate 86 is then secured as by means of screws, to the rearward sides of legs 82 and 84, the retainer plate spanning the legs and extending thereabove to engage the rear surface of nut 58. In similar manner, retainer plate 86' spans elements 82' and 84'. The retainer plates 86, 86' and the flanges on legs 82, 82' and 84, 84' thus grip nut 58 and secure the adapter in place. It will be seen that the retainer plates are curved to fit snugly onto the curved outer surface of the nut. It will be apparent that the exact shape of the inner surfaces and the exact location of the supports will depend upon the axial location of the adapter with respect to the nozzle, for, as will be explained below, the adapter may be positioned in a variety of longitudinal locations with respect to the discharge point of the fluid spray. Again, the mounting supports are of a dielectric material, and any suitable number of supports may be provided. A variety of spacers may be utilized and the number and placement of such elements will depend upon the particular spray gun to which the adapter is being mounted. The shaped spacers of the type illustrated herein provide a removable mounting for the adapter; if desired, the adapter can be permanently attached to the spray device, may be held in place by frictional engagement, or may take other alternative forms.

It is preferred that the adapter 64 be of greater inner diameter than the outer diameter of the barrel portion of the spray gun so that ambient air can flow through the adapter from the rear for mixture with the air and liquid exiting from the discharge ports of nozzle assembly 16. The aspiration of air through the adapter is caused by the spray discharge, and this flow minimizes turbulence in the area of the spray nozzle and thus reduces the tendency of the spray gun to deposit atomized and charged spray particles on the exterior of the nozzle assembly and barrel portion of the gun. Since the air thus aspirated through the adapter is drawn from behind the spray nozzle, the air is relatively clean. Although an aspirating effect is provided by a cylindrical adapter, it has been found that an improved effect is obtained by providing a series of apertures or windows 88 through 93 around the circumference of the rearward portion 66 of the adapter. These windows, together with the cutaway portions of the tube, increase the aspirating effect of the adapter, and assist in reducing turbulence and in keeping the interior of the adapter and the exterior surface of the spray gun relatively free of spray material.

The electrostatic field by means of which the adapter 64 produces induction charging of the spray droplets emitted by nozzle assembly 16 is generated by means of a pair of charging electrodes 96 and 98. These electrodes are mounted to the inner surfaces of lobes 76 and 78, respectively, of the adapter and thus are positioned on diametrically opposite sides of the nozzle assembly 16. The electrodes are spaced from the nozzle assembly and are concentric therewith, having curved surfaces which are equidistant from the longitudinal axis of the spray nozzle. Each of the electrodes is, in effect, a segment of a cylinder of slightly smaller diameter than the cylinder which forms the adapter. The electrodes are spaced from the spray nozzle by a distance sufficient to insure a good flow of aspirated air between the electrode and the spray nozzle, yet are close enough to provide the desired potential gradient between the surface of the electrodes and the grounded supply of liquid fed to spray nozzle 26.

As described in the aforementioned copending application, the electrodes may be in the form of a metallic foil or coating adhered or otherwise formed on the inner surface of the adapter housing. However, in the present invention, in its preferred form, the electrodes comprise metallic or other electrically conductive layers or coatings attached to and supported by a substrate which is, in turn, supported by suitable spacers attached to the interior surfaces of the lobes 76 and 78. Thus, the electrode 96 may consist of a substrate 100 formed, for example, from a suitable dielectric material and supporting a layer or metal foil 102, the edges of which may be covered by a bead of epoxy to eliminate sharp edges and prevent corona discharges. As may be seen most clearly in FIGS. 4 and 5, electrode 96 is shaped to be generally congruent with the shape of lobe 76 and is of sufficient size that the lobe falls within the radial shadow of the electrode; i.e., a radial line from the axis of the fluid nozzle passing by the edge of the electrode would not fall upon the lobe. The electrode is provided with a cylindrical curvature so that it may be mounted radially equidistance from the longitudinal axis of the spray gun and is secured to the lobe 76 by means of a pair of spacers 104 and 106. The spacers are of a dielectric material, such as nylon, and are attached to the lobe by means of suitable screws 108, also of a dielectric material. In similar manner, the electrode 98 is formed from a substrate 100' to which is attached a conductive layer 102', with the electrode being secured to lobe 78 by means of supports 104' and 106' secured by screws 108'.

The dielectric spacers 104, 104', 106, 106' are shaped to insure a smooth air flow in the space between the electrodes and the outer lobes 76 and 78. The spacers preferably are small and are located well away from any edges of either the electrodes or the supporting lobes to prevent electrical leakage paths from developing. Such leakage may occur by reason of the relatively high voltage carried by the conductive foil electrode, and may occur between the foil and grounded portions of the outer surface of the adapter tube during operation, should particles or ambient moisture accumulate on the various surfaces. Such leakage would reduce the high voltage or even short circuit the electrode and thus reduce if not eliminate the induction effect.

Figure 6:
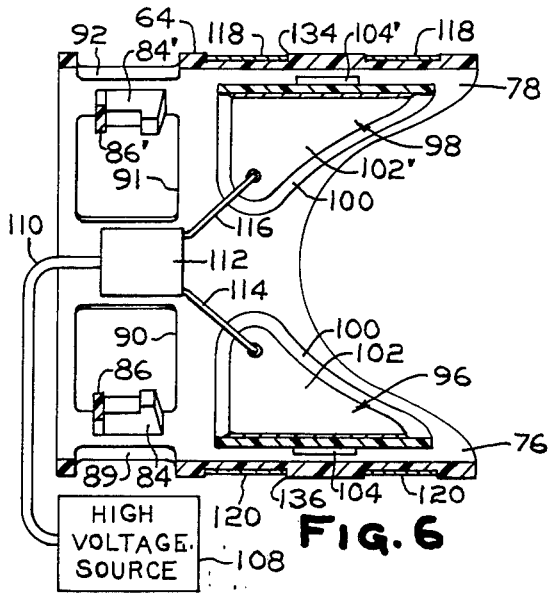
FIG. 6 is a cross-sectional view of the adapter of FIG. 4, taken along lines 6—6.

To provide the required electrostatic field for the liquid spray discharged by the spray gun, a source of relatively high d.c. voltage which may be of either polarity with respect to the reference ground point and which is diagramatically indicated at 108 in FIG. 6, is connected by way of a main power cable 110 which leads, in the case of an adapter unit mounted on a conventional spray gun, along the exterior of the barrel of the gun to a connector block 112 secured to the interior of adapter 64. Block 112 provides a connection between cable 110 and a pair of secondary cables 114 and 116 leading to and connected to the electrically conductive material on the inner surfaces of electrodes 96 and 98, resectively. In the preferred apparatus, a high positive or negative voltage is supplied to the two opposed electrodes 96 and 98, and this voltage produces an electrostatic field between the electrodes and the electrically grounded liquid spray discharged from the spray gun. This field defines a charging zone within the adapter which serves to induce an opposite charge on any particulate liquids passing therethrough. The voltage at source 108 can vary over a wide range, but preferably is less than about 20 kilovolts. The magnitude of the voltage required to achieve optimum charging efficiency depends upon the radial distance between the surfaces of the electrodes and the axis of the liquid flow, on the longitudinal, or axial location of the adapter with respect to a plane perpendicular to the axis of the adapter and passing through the discharge point of the nozzle, on the rates of air and liquid flow from the nozzle, and the like. Thus, as the induction charging electrodes are moved radially outwardly from the axis of the liquid flow, higher voltages are required to achieve the optimum charging efficiency. Although it would be detrimental to performance if the charging electrodes were sufficiently small or sharp, or the voltage sufficiently high, to produce corona discharges, the exact number, shape, size and spacing of the electrodes is not critical. It has been found that optimum results are obtained when the average potential gradient within the charging zone, between the charging electrodes and the liquid nozzle, it between about 5 and about 20 kilovolts per inch, and preferably is between about 10 and 14 kilovolts per inch.

In a less desirable embodiment, the electrical potential may be applied to the liquid supply, with the electrodes 96 and 98 being held at the ground reference potential, thereby reversing the direction of the electrostatic field developed within the adapter 64. With the same average field parameters described above, charges will be induced within the charging zone on particles by the spray nozzles; however, this embodiment has the disadvantage of maintaining the liquid supply at a high voltage level with its accompanying risk of injury to the operator and possible fire hazard.

In the preferred form of the invention, where the electrodes 96 and 98 are maintained at a high positive or negative voltage, the safety factor may be improved by providing a current limiting resistor within the power supply to protect both the supply and the operator. Such resistors are known in this art, and serve to limit the amount of current that can flow in the system in the event of arcing caused by a breakdown of insulation, by an accumulation of charged particulate matter, by contact of the electrodes with a grounded object, or the like. However, a greater degree of safety is provided by the present invention through the provision of grounding electrodes, or shields, on the exterior surface of the adapter. Such shields, illustrated in the drawings at 118 and 120, preferably are in the form of a conductive film or foil secured to the exterior surfaces of the adapter lobes, with shield 118 being on the exterior surface of lobe 78 and shield 120 being on the exterior surface of lobe 76. As illustrated, the shields generally conform in shape to the shape of the lobes, approaching the edges thereof, and extending between about one-half and about two thirds the length of the adapter. The external electrodes thus lie within the radial shadow of the charging electrodes 96 and 98, thereby reducing the tendency for charged particles to collect along the edges of the lobes and shield electrodes.

The shield electrodes are located within shallow recesses formed in the exterior surfaces of the lobes 76 and 78 so as to flush with or insert slightly below the lobe surfaces, thereby reducing the likelihood of sharp edges producing corona discharges. To further reduce this possibility, the peripheral edges of the shield electrodes are covered by a bead of epoxy which acts as a fillet between the electrode and the surface of the lobe, as generally illustrated in FIGS. 2, 6 and 8.

Figure 7:
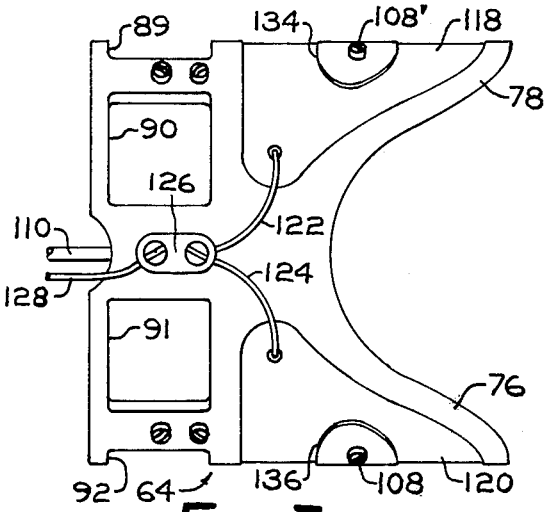
FIG. 7 is a bottom plan view of the adapter of FIG. 1.

Shields 118 and 120 are connected to an electrical reference point, preferably ground, as illustrated in FIG. 7, by way of wires 122 and 124 which may be connected to a metallic connector plate 126 suitably secured to or embedded in the exterior surface of the adapter. The connector 126 may be, for example, a brass foil insert secured to the adapter by rivets or other suitable fasteners to provide good electrical contact with the wires 122 and 124 which may be adhered to or embedded in the dielectric material of the adapter. A ground wire 128 is secured to the connector plate 126 and is adapted to make contact with a suitable electrical ground reference point 130. The ground plate 54 (FIG. 2) which contacts the liquid supply for the spray gun either within or outside the gun, as well as other ground points on the spray gun, are also connected to the electrical ground point 130 so that the shield electrodes 118 and 120 are maintained at ground potential in common with the liquid supply.

Figure 8:
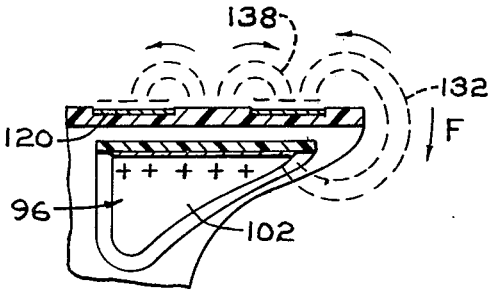
FIG. 8 is a partial sectional view of the adapter of FIG. 1.

As illustrated in FIG. 8, the presence of the grounded shield electrodes on the exterior surfaces of the adapter produces an electrical field 132 around the forward and side edges of each of the lobes, extending between the charging and the shielding electrodes mounted on opposite surfaces of each lobe. The electric field 132 produces a deflecting force F on the charged particles emitted from the spray gun, preventing such particules for reaching the surface of the adapter. Thus, if a positive potential is applied to the charging electrode 96, as illustrated in FIG. 8, negative charges will be induced on the particulate matter within the charging zone. Negatively charged particules which are discharged from the charging zone within the adapter will normally be directed toward a workpiece by reason of the air flow from the spray nozzle and through the adapter or by reason of an attracting potential on the workpiece, or both. Often, however, the negative particles which travel near the forward edge of the adapter tend to be attracted around the edge and back toward the gun and adapter, where they will collect if a positive charge has built up on the gun and adapter surfaces. It has been found that without the shield electrodes the dielectric material of the adapter lobes acts as a capacitor with one conductive plate removed, so that when a light voltage is applied to the electrodes, the exterior surfaces thereof become charged, this charge having the same polarity as the electrodes. Thus, external grounded shield electrodes are provided, thereby creating the electric field illustrated in FIG. 8. This field is in a direction to repel the negatively charged particles back to the main stream of the spray, while any positively charged particles will be directed by a force opposite to that indicated at F in FIG. 8, and thus will also be deflected away from the surface of the adapter, but in the opposite direction.

Although the shield electrodes 118 and 120 may be continuous sheets of conductive material to provide continuous grounded surfaces on the exterior surfaces of the lobes, it has been found that improved results can be obtained by providing in the electrodes 118 and 120 corresponding cut-out portions 134 and 136, respectively. The shield electrodes have the generally annular shape illustrated in the drawings, with a thickened area of the dielectric material used in constructing the adapter being exposed in the center portion of each electrode. Since, as indicated above, the dielectric material of the adapter will gradually take on a positive charge with respect to the ground potential of electrodes 118 and 120, the central opening in the electrodes becomes positive and creates an additional electrostatic field 138 between the dielectric material and the electrode. This field provides a further deflection of any charged particles that may drift out of the main stream of the spray and thus serves to prevent such particles from accumulating on the exterior surface of the adapter. Although FIG. 8 illustrates the electrical field directions and forces for a positive voltage applied to electrode 96, it will be apparent that the same general effect occurs when the operating polarities of the system are reversed.

The grounding of the exterior surfaces of the adapter lobes serves two primary functions. The first of these, as discussed above, is to produce electric field lines of force between the grounded outer surface of the adapter lobes and the corresponding inner high voltage electrodes. These electric field lines wrap around the full length of the edges of each of the lobes of the adapter to apply a deflecting force to charged particles which might otherwise be attracted to the adapter. This arrangement is very effective in preventing accumulation of spray material such as paint on the exterior portion of the adapter. It has been shown in tests that with given spray materials and given operating parameters, the grounded shield electrode on the outer surface of the adapter virtually precludes accumulation of spray particles, whereas with the same operating parameters, but no shield, there will be substantial accumulation over the same period of time. The central apertures 134 and 136 in the shield electrodes further improve this performance by reinforcing the deflecting field lines around the adapter.

The second primary function of the grounded exterior surface is that of safety. With the exterior surface at ground potential, the adapter can be safely touched by an operator or by an object at grounded potential with no danger of a shock or spark. There is virtually no accumulation of charged particles on the surface of the adapter and thus no problem of accidential sparking or electrical shock. The exact dimensions of the exterior shield electrodes are not critical, nor is the exact spacing between the various electrodes; however, it should be noted that the electrodes should be sufficiently far apart from each/other to prevent breakdown through or around the dielectric material and that all edges should be rounded to reduce this problem.

As indicated in the aforementioned copending application Ser. No. 456,944, the axial position of the inductive charging adapter relative to the spray nozzle is not critical. The adapter is located exteriorly of the discharge ports, and is preferably positioned so that at least a portion of each of the charging electrodes extends forward of the radially extending plane defined by the air and fluid discharge ports. If desired, however, the entire length of the adapter could extend forward of this plane, although such a location would increase the tendency to accumulate liquid particles on the adapter. Similarly, the forward end of the adapter could lie in or slightly behind the plane of the discharge ports, but is has been found that with such a location optimum results generally are not obtained.

Neither the size of the charging electrodes nor the radial distance between the electrodes and the air and liquid discharge ports is critical. These dimensions generally will be dependent upon the size of the spray device used, and thus the adapter may range in diameter from about one and one-half inches to over three inches, with lengths ranging from ¾ of an inch to over 3 inches; again, however, it is emphasized that these sizes can be varied over a wide range. Of course, with changes in dimension, the voltages required to provide the optimum electrostatic field gradient will vary.

The air pressure used in conjunction with the spray gun is not critical, and can vary accordingly to the particular degree of atomization and particle size desired. In fact the adapter can be used with the so-called "airless" spray devices which operate on liquid pressure alone, without the need for an air supply. However, for any given fluid flow rate and charging electrode configuration, the total particle flow to a grounded target, or workpiece, (and thus the charging efficiency) generally increases with increasing fluid pressure. Air pressure, as measured at the input to the spray device, of between about 20 and 70 psi is generally used with the air type guns; similarly, the liquid flow rate varies with the degree of atomization and particle size desired, and will generally vary between about 100 ml per minute and about 500 ml per minute.

Induction charging adapters in accordance with the present invention have been constructed and tested and have been found to produce satisfactory results, comparable to prior art electrostatic systems, but utilizing lower voltages and providing an increased margin of safety. The following examples of such operation are given as illustrative of the invention, and are not to be construed as limiting. All parts and percentages in the examples are by weight unless otherwise indicated.

EXAMPLES

An induction charging adapter made in accordance with the present invention was mounted on a Binks Model 610 Automatic spray gun utilizing a Binks N63PB air cap modified to fit the 610 gun, a Binks D63B liquid nozzle and a Binks 463A fluid needle, operated at full fan. The gun was connected to a supply of paint, and the gun, paint container and the exterior shield electrodes on the adapter were connected to an electrical ground potential. The high voltage power supply was connected through a 100 megohm resistor to the charging electrodes.

The adapter was constructed in the form of a tube from glass cloth embedded in epoxy, the tube being 3 inches in length and 3 inches in diameter with ⅛ inch wall thickness. The charging electrodes consisted of an aluminum foil 1.5 mil thick epoxied to the inner surfaces of two opposed electrode plates cut from an epoxy tube 1½ inches long, 2½ inches in diameter, and having a wall thickness of ⅛ inch. The electrode plates were mounted to the interior of the adapter by means of nylon spacers sufficiently large to maintain a 2½ inch diametric spacing between the electrode surraces, with the forward edges of the electrode plates being set back from the forward edges of the adapter tube 1/16 inch. To form the lobes on which the electrodes were mounted, the adapter tube was cut out to a depth of 1 15/16 inches, at an angle to produce lobes having a minimum width at their forward ends of less than about 1½ inches. The exterior shield electrodes consisted of 1.5 mil aluminum foil secured by an epoxy adhesive to the outer surfaces of the adapter lobes. All edges were rounded, and an epoxy bead was applied along the edges of the metal foil.

The adapter was secured on the air cap of the Binks spray gun so that slightly more than one-half the length of the adapter extended forward of the plane defined by the nozzle discharge ports.

In a first example, the spray gun was operated with the following paint formulation under the following conditions:

| | | |
|---|---|---|
| Paint | | |
| Percent non-volatile solids: 34 | | |
| Solids: | 11 parts titanium dioxide | |
| | 89 parts of an amine-solubilized acrylic interpolymer having an acid value of 13.4 | |
| Solvents: | 81 parts water | |
| | 17 parts butyl carbitol | |
| | 2 parts dimethylaminoethanol | |
| Viscosity: | 23.0 sec., No. 4 Ford cup | |
| Flow Rate: | 200 gm/min. | |
| Spray Gun | | |
| Air Pressure (into gun): | | 60 PSIG |
| Input Voltage (supply): | | 14 KV (D.C.) positive |
| Input Current: | | Less than 0.5 $\mu$A |
| Target Current: | | 7.0 $\mu$A |

In a second example, the spray gun was operated with the following paint formulation under the following conditions:

| | |
|---|---|
| Paint | |
| Percent non-volatile solids: 48 | |
| Solids: | 28 parts titanium dioxide |
| | 54 parts of an amine-solubilized acrylic interpolymer having an acid value of 13. |

-continued

| | |
|---|---|
| | 11 parts of a sucrose polyether polyol<br>7 parts of a melamine-formaldehyde resin. |
| Solvents: | 74 parts water<br>14 parts methyl cellosolve<br>3 parts butyl alcohol<br>6 parts tert-butyl alcohol |
| Viscosity: | 25.5 sec., No. 4 Ford cup |
| Flow Rate: | 200 gm/min. |
| Spray Gun | |
| Air Pressure (into gun): | 60 PSIG |
| Input Voltage (supply): | 14 KV (D.C.) positive |
| Input Current: | 1.0 $\mu$A |
| Target Current: | 6.5 $\mu$A |

In both examples, the paint was sprayed onto a flat workpiece, or target, 48 inches by 17 inches, spaced 12 inches from the spray nozzle and electrically grounded. In both instances, uniform paint films were produced on the target, with no corona discharge being observed and with virturally no particle accumulation on the spray gun nozzle or the adapter.

Thus there has been described an improved, novel electrostatic device for inducing electrostatic charges on liquid particles. Although the adapter has been described in terms of a specific embodiment, it will be understood that this is merely exemplary of the invention, and that various changes may be made without departing from the inventive concept. Thus, the device is shown in the form of an adapter attachable to conventional spray gun, but it will be seen that a variety of mounting configurations may be provided for using the device with different spray devices. Further, the adapter may be semi-permanently or even permanently to a spray nozzle, or may be manufactured as a unitary part of a spray gun, with suitable changes in the adapter housing and electrode configurations. The particular size, shape and spacing of the various electrodes will depend upon the gun to which the device is to be applied, the material to be sprayed, and other design parameters. These various features provide an induction type electrostatic spray device of improved performance and safety, and accordingly it is desired that the true spirit and scope of the invention be limited only by the following claims.

What is claimed is:

1. An electrostatic spray coating apparatus comprising:

an electrically nonconductive spray nozzle having liquid discharge ports;

induction charging means including electrode means located exteriorly of said discharge ports and defining a charging zone through which passes liquid discharged from said nozzle;

means applying a relatively high electrical potential to said electrode means;

shielding means for said induction charging means; and means applying a reference potential to said shielding means.

2. The apparatus of claim 1, wherein said induction charging means comprises first and second electrodes mounted on diametrically opposed sides of said spray nozzle.

3. The apparatus of claim 2, wherein said shielding means comprises third and fourth electrodes mounted on said diametrically opposed sides of said spray nozzle, said third and fourth electrodes being disposed exteriorly of said first and second electrodes, respectively.

4. The apparatus of claim 1, wherein said shielding means comprises electrode means mounted exteriorly of said induction charging means.

5. An induction charging adapter comprising:

a first substantially cylindrical dielectric tube;

dielectric spacer means secured to the interior surface of said tube;

induction charging means secured to said spacer means and supported within said tube; and shield means secured to the exterior surface of said tube.

6. The adapter of claim 5, further including means for applying an electric potential to said induction charging means.

7. The adapter of claim 5, further including means for applying an electric ground potential to said shield means.

8. The adapter of claim 5, wherein said induction charging means comprising electrically conductive electrode means.

9. The adapter of claim 5, wherein said shield means comprises electrically conductive electrode means.

10. The adapter of claim 5, wherein said induction charging means comprises at least first and second spaced, electrically conductive induction electrodes, and means for applying an electric potential to each of said induction electrodes.

11. The adapter of claim 10, wherein said shield means comprises at least first and second spaced, electrically conductive shield electrodes, and means for applying an electrical ground potential to each of said shield electrodes.

12. The adapter of claim 11, wherein each of said first and second induction electrodes includes a dielectric mounting plate secured to dielectric spacer means, and an electrically conductive layer on the interior surface of said plate, whereby upon application of said electric potential to said induction electrodes an electrostatic field is produced within said tube.

13. The adapter of claim 12, wherein each of said first and second shield electrodes comprises an electrically conductive layer on the exterior surface of said tube.

14. The adapter of claim 13, wherein said dielectric tube is shaped to provide first and second projecting lobes, said first and second induction electrodes being secured to the interior surfaces of said first and second lobes, respectively, and said first and second shield electrodes being secured to the exterior surfaces of said first and second lobes, respectively.

15. The adapter of claim 14, wherein said shield electrodes are generally annular in shape.

16. The adapter of claim 14, wherein said lobes are formed on diametrically opposed portions of said tube.

17. The adapter of claim 14, further including mounting means secured to the interior surface of said tube for supporting said adapter on a spray gun having a discharge nozzle, and positioning said induction electrodes exteriorly of the discharge nozzle.

18. The adapter of claim 14, wherein said electrodes are comprised of metallic foil.

19. The adapter of claim 14, wherein each said induction electrode mounting plate comprises a segment of a cylinder of smaller diameter than the diameter of said tube, and wherein the shape of each said induction electrode mounting plate is substantially the same as the shape of the lobe to which it is secured.

20. The adapter of claim 19, wherein the shape of each of aid electrodes is substantially the same as the shape of the lobe to which it is secured.

21. An electrostatic spray charging device for spray guns comprising:

first and second electrically conductive induction electrodes spaced to define a charging zone;

first and second electrically conductive shield electrodes spaced outwardly from said first and second induction electrodes, respectively, means for discharging spray particles through said charging zone; and means producing a first potential difference between said induction electrodes and said spray particles for inductively charging said particles and for producing a second potential difference between said induction electrodes and respective shield electrodes whereby charged particles are repelled from said shield electrodes.

22. The spray charging device of claim 21, wherein each of said shield electrodes incorporates an aperture, said device further including means producing a third potential difference between each of said shield electrodes and its aperture to further repel charged particles from said shield electrodes.

23. The spray charging device of claim 22, wherein said first potential difference produces an electrostatic field gradient for inductively charging said particles, and wherein said second and third potential differences produce protective electrostatic fields, whereby said charged particles are prevented from migrating to said shield electrode.

24. Electrostatic induction charging apparatus for producing a high degree of electrostatic charge on the particles of an air-atomized stream, comprising:

a support housing including first and second lobes;

first and second spaced electrode means secured to said housing on said lobes and defining a charging zone in which said air-atomized stream of particles is formed and through which said stream of particles passes; and means for applying a relatively high potential to both said electrode means, said potential being sufficiently high to produce induction charging on the particles formed within said charging zone but insufficient to produce corona effects.

25. The appearance of claim 24, wherein each said electrode comprises a dielectric mounting plate secured by means of dielectric spacer means to the interior surface of a corresponding lobe, and an electrically conductive layer on the surface of said plate adjacent said charging zone.

26. The apparatus of claim 24, further including first and second shield electrodes, each said shield electrode being spaced outwardly of a corresponding one of said first and second electrodes, with respect to said charging zone to provide a protective electrostatic field.

27. The apparatus of claim 24, further including means on said support housing for facilitating a flow of aspirated ambient air therethrough.

28. Electrostatic induction charging apparatus for producing a high degree of electrostatic charge on particles of an air-atomized stream, comprising:

support means comprised of dielectric material;

induction charging electrode means secured to said support means and defining a charging zone in which said air-atomized stream of charged particle is formed, said stream being confined substantially entirely to passage through a region of said zone, which region is spaced apart from the electrode means; and shield means for said induction charging electrode means.

29. The apparatus of claim 28, wherein said electrodes are located on opposite sides of said charging zone to provide a substantially uniform electrostatic charging field.

30. The apparatus of claim 28, further including means for applying an electric potential to said induction charging means and means for applying an electric ground potential to said shield means.

31. The apparatus of claim 28, wherein said shield means are shielding electrodes comprising an electrically conductive layer on the exterior surface of said support means.

32. The apparatus of claim 31, wherein each of said shield electrodes incorporates an aperture, said apparatus further including means producing a third potential difference between each of said shield electrodes and its aperture to further repel particles from said shield electrodes.

33. The apparatus of claim 31, wherein said support means is shaped to provide projecting lobes with induction charging electrodes secured to the interior surfaces of said lobes and shielding electrodes secured to the exterior surfaces of said lobes.

34. The apparatus of claim 28, further including mounting means secured to the interior surface of said support means for supporting said apparatus on a spray gun having a discharge nozzle, and positioning said induction charging electrodes exteriorly of the discharge nozzle.

35. The apparatus of claim 28, further including means on said support means for facilitating a flow of aspirated ambient air therethrough.

* * * * *

UNITED STATES PATENT AND TRADEMARK OFFICE

CERTIFICATE OF CORRECTION

PATENT NO. : 4,009,829

DATED : March 1, 1977

INVENTOR(S) : James E. Sickles

It is certified that error appears in the above-identified patent and that said Letters Patent are hereby corrected as shown below:

Claim 20, line 2, delete "aid" and insert --said--.

Claim 25, line 1, delete "appearance" and insert --apparatus--.

Claim 28, line 7, delete "particle" and insert --particles--.

Claim 32, line 5, after "repel" insert --charged--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*